US007789761B1

(12) United States Patent
Lumsden

(10) Patent No.: US 7,789,761 B1
(45) Date of Patent: Sep. 7, 2010

(54) RECREATIONAL STAIRWAY SLIDE

(76) Inventor: Piper Lumsden, 3660 White Trillium, Saginaw, MI (US) 48603

( * ) Notice: Subject to any disclaimer, the term of this patent is extended or adjusted under 35 U.S.C. 154(b) by 319 days.

(21) Appl. No.: 11/148,797

(22) Filed: Jun. 9, 2005

(51) Int. Cl.
*A63G 21/02* (2006.01)

(52) U.S. Cl. ..... 472/116; 472/134; 182/48; 244/137.2

(58) Field of Classification Search ..... 472/116, 472/117, 128, 129, 134, 136, 137; 182/48–50; 244/137.2
See application file for complete search history.

(56) References Cited

U.S. PATENT DOCUMENTS

| | | | | |
|---|---|---|---|---|
| D190,125 | S | 4/1961 | Ahrens | |
| 3,463,287 | A | 8/1969 | Smith | |
| 3,465,991 | A | 9/1969 | Banas et al. | |
| 3,656,579 | A | 4/1972 | Fisher et al. | |
| 3,743,281 | A * | 7/1973 | Gimbel | 472/116 |
| 4,813,663 | A * | 3/1989 | Rice | 472/116 |
| D328,326 | S | 7/1992 | Kuan | |
| 5,197,924 | A * | 3/1993 | Gerrells | 472/116 |
| D340,965 | S | 11/1993 | Lee | |
| 6,471,001 | B1 * | 10/2002 | Baker et al. | 182/48 |
| D472,292 | S | 3/2003 | Peterson | |
| 6,558,264 | B2 | 5/2003 | Gordon | |
| 6,650,246 | B2 | 11/2003 | Field et al. | |
| 6,695,096 | B2 * | 2/2004 | Idler et al. | 182/48 |
| 6,769,647 | B2 * | 8/2004 | Moro et al. | 244/137.2 |
| 6,877,698 | B2 * | 4/2005 | Baker et al. | 244/137.2 |

* cited by examiner

*Primary Examiner*—Kien Nguyen

(57) ABSTRACT

A stairway slide assembly including an anchoring approach pad at the top of the stairway, an intermediate inflatable slide section for overlying the stairway steps and an deceleration section at the bottom of the stairway. A slide section includes a plurality of inflatable, longitudinally extending air passages which are formed by sealing laterally spaced apart elongate confronting portions of a pair of air impervious sheets. An inflatable support base is coupled to and underlies the slide and includes transversely extending inflatable air passages received on the steps and supporting the underside of the slide in spaced relation with the underlying steps.

26 Claims, 7 Drawing Sheets

RECREATIONAL STAIRWAY SLIDE

BACKGROUND OF THE INVENTION

1. Field of the Invention

This invention relates to an inflatable stairway slide assembly for facilitating one's sliding down a conventional stairway having a plurality of steps and more particularly to an inflatable stairway slide coupled to an underlying inflatable base that supports the slide in spaced relation with the underlying stairway steps.

2. Description of Prior Art and Advantages

Parents sometimes find it inconvenient to transport a child to an outdoor park to use a conventional outdoor slide. Inclement weather will also interfere with a child using a conventional outdoor slide. Sometimes, a parent must care for a younger child who must nap when an older child wants to play on a slide. A slide constructed according to the present invention has the advantage of being inflatable for indoor use on a stairway. Indoor slides have been provided heretofore such as that illustrated in U.S. Des. Pat. No. 0472,2928 issued to LeRoy J. Peterson on Mar. 25, 2003; Des. No, 328,326 issued to Frank C. Kuan on Jul. 28, 1992; and Des. No. 340,965 issued to Roger Lee on Nov. 2, 1993. Such slides are relatively small, but bulky and sometimes inconvenient to store. It is an advantage of the present invention to provide a new and novel inflatable slide assembly which will mount atop the steps on one side of a stairway leaving the other side of the stairway available for normal use.

Various inflatable slides have been provided heretofore for emergency evacuation of passengers from airplanes, such as that illustrated in U.S. Pat. Nos. 3,463,287; 3,465,991; and 3,656,579. If used on a stairway, the prior art airplane slides may provide a bumpy and painful ride as the child downwardly negotiates successive treads of stairway steps. According to the present invention, an inflatable base is provided for underlying and supporting the inflatable slide in spaced relation with the stairway steps. The invention contemplates utilizing a plurality of longitudinally spaced apart transversely extending inflatable tubular sections disposed in the space defined by each stairway tread and its adjacent riser and inflated to a level to support the inflatable slide in spaced relation with the treads.

The stairway slide constructed according to the present invention is fabricated from a pair of thin plastic sheets that are sealed together at selected intervals to provide longitudinal air passages. The invention includes an inflatable base which underlies the slide to protect a person from being bruised by contact with one or more of the underlying steps as the person slides down the stairway. Accordingly, it is an advantage of the present invention to provide an underlying inflatable support base which supports the slide in vertically spaced relation with the top sharp edges of the underlying stairway steps.

It is another advantage of the present invention to provide a slide assembly of the type described including, at its discharge end, a separately inflatable deceleration section which includes an enlarged terminal bumper. The stairway slide assembly constructed according to the present invention contemplates an approach pad coupled to the inflatable slide and anchored to the stairway and also detachably mounting intermediate members for detachably coupling the slide to the stairway steps to preclude lateral movement thereof.

The invention contemplates the underlying base including cylindrical, inflatable tubes which are received in the crotch of each successive step whereas another embodiment of the present invention contemplates triangular inflatable sections which extend to a level slightly above the steps, and another embodiment adds reduced diameter transversely extending, inflatable edge protector tubes disposed between the cylindrical tubes.

The inflatable stairway slide and the underlying base are each formed with a pair of sheets that are sealed at portions to define air passages therebetween which can be inflated to provide longitudinally extending airway passages in the upper slide section and transversely extending airway passages to the underlying base, In one embodiment of the invention, the sheets of the upper slide and the underlying base are integrally coupled whereas in another embodiment, the underlying base is detachably coupled to the slide.

In all cases, however, the slide assembly is easily inflated for quick assembly and easily deflated for quick and easy disassembly and storage.

These and other advantages of the present invention will become more readily apparent as the descriptions hereof proceeds:

SUMMARY OF THE INVENTION

A stairway slide assembly comprising an elongate, inflatable slide section for mounting atop the steps on one lateral side of a stairway, and an inflatable base including a plurality of longitudinally spaced apart transversely disposed inflatable tubular sections adapted to be received on the steps for yieldably supporting the slide in spaced relation with the steps.

BRIEF DESCRIPTION OF THE DRAWINGS

The invention may be more readily understood by referring to the accompanying drawings, in which.

DESCRIPTION OF PREFERRED EMBODIMENT

Figure 1:
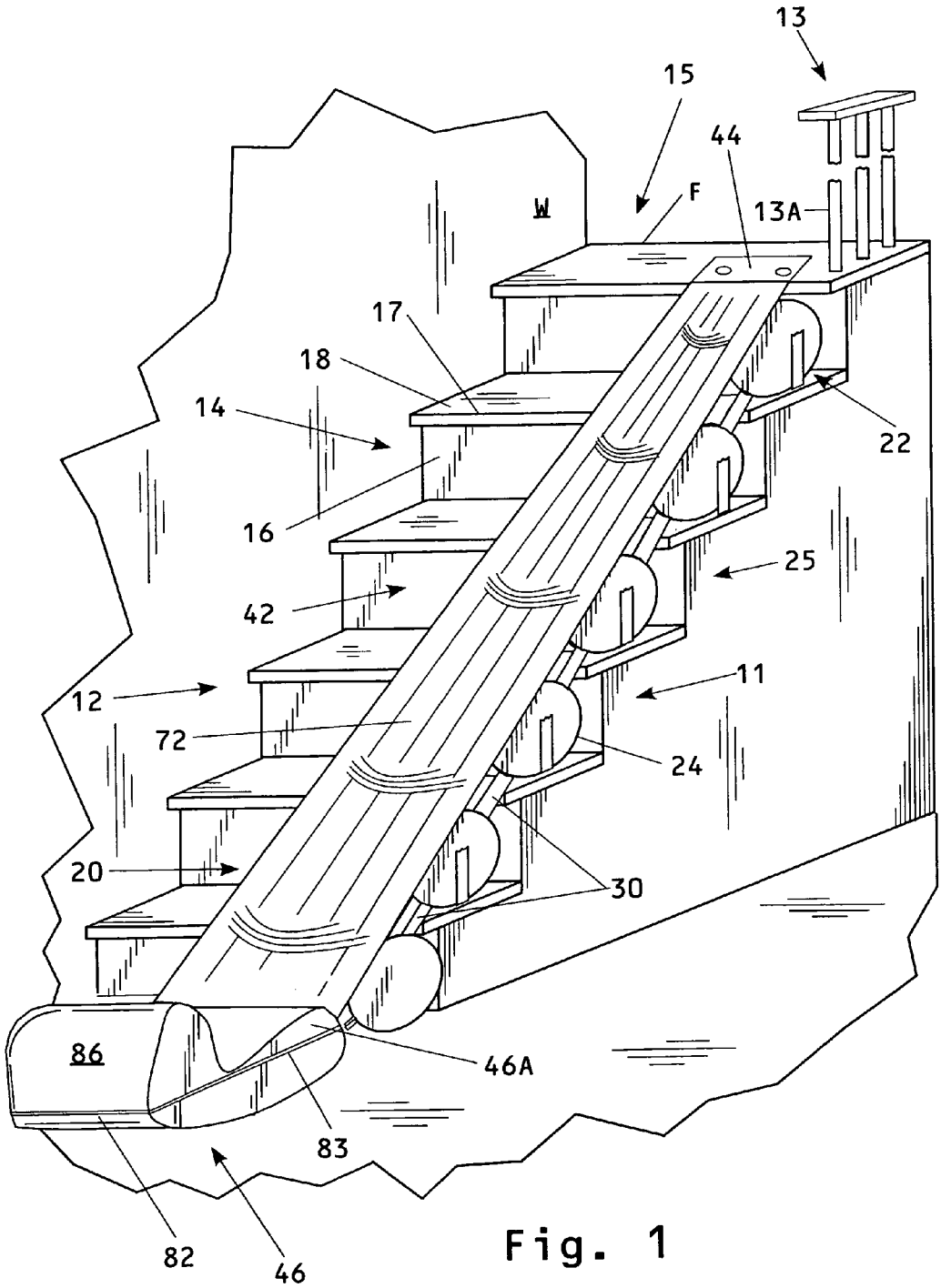
FIG. 1 is a perspective view illustrating a slide assembly constructed according to the present invention operatively mounted on a conventional stairway which includes a plurality of steps.

A portable, recreational, stairway slide assembly, generally designated 11 and constructed according to the present invention, is particularly adapted for use on one lateral side of a conventionally vertically inclined stairway, generally designated 12, having a plurality of longitudinally spaced apart steps 14 each provided with a riser 16 and a horizontal tread 18 defining a sharp front edge 17. A railing 13, including upstanding spindles 13A, and an upstanding wall W are mounted on laterally opposite sides of the stairway, as usual. The stairway 12 extends between an upper level floor F and a lower level landing or floor L.

The portable stairway slide assembly 11 is disposed atop the steps 14 along one lateral side of the stairway adjacent the railing 13 while leaving the other lateral side 15, adjacent the wall W open for normal use. The slide assembly 11 includes an upper slide, generally designated 20, and an underlying, inflatable base, generally designated 22.

The base 22 is fabricated from a pair of upper and lower confronting PVC plastic sheets 26 and 28, respectively, which include a non-inflatable, sealed head end or entrance pad 21, a heat sealed tail end 23, and an intermediate inflatable, step filling slide support base section 25 longitudinally disposed therebetween. The upper and lower PVC sheets 26 and 28 of base 22 are heat sealed together at a plurality of longitudinally spaced, transversely extending confronting sealed portions 30 as well as confronting lateral edge sealed portions 31 and 36. The sealed portions 30 are disposed above the front sharp edge 17 of each step. The longitudinally spaced confronting portions 26A and 28A, of the sheets 26 and 28, respectively, between the longitudinally spaced sealed portions 30, are not sealed together but rather inflatable and expandable to provide a plurality of longitudinally spaced apart laterally extending inflatable, step filling, slide support tubes or cushioning members 24 of a predetermined breadth B sufficient, when inflated, to support the underside 32 of the slide 20 in spaced relation with the front step edges 17.

Figure 3:
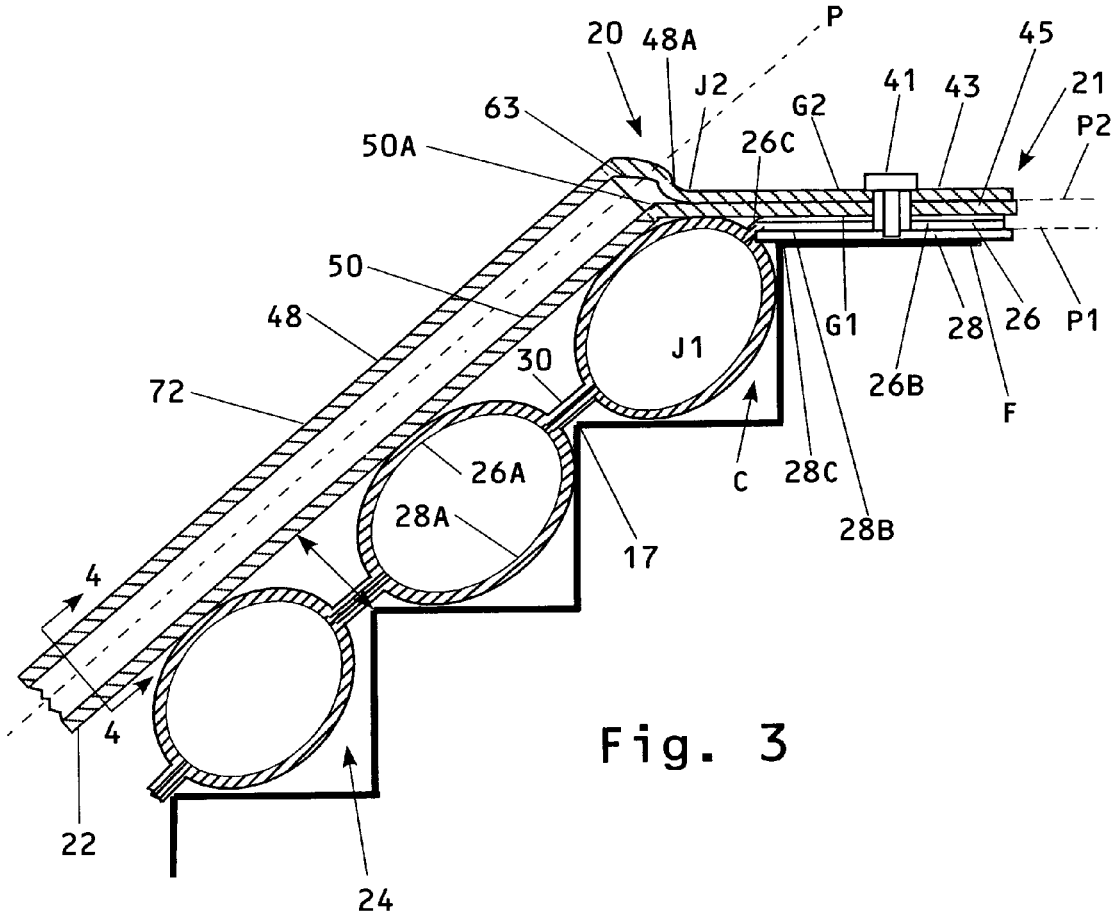
FIG. 3 is a greatly enlarged sectional view, taken along the section line 3-3 of FIG. 2, more particularly illustrating the upper portion of the slide and the underlying inflatable base mounted on the stairway.

The upper confronting entrance or head end 26B and 28B of the sheets 26 and 28, respectively, are heat sealed together to form the entrance pad 21 which includes grommets G1 therethrough that detachably receive fasteners 41 to detachably couple the underlying base 22 to the top stairway floor F and inhibit movement of the inflatable base 22 on the underlying stairway. The portions of sealed sheet head ends 26C and 28C immediately adjacent the uppermost tube 24 form a junction J1 which allows the entrance pad 21 to fold downwardly out of the plane P of the inflatable base section 25 to the inclined position, lying in a plane P1, as illustrated in FIG. 3, overlying the upper floor F.

Figure 5:
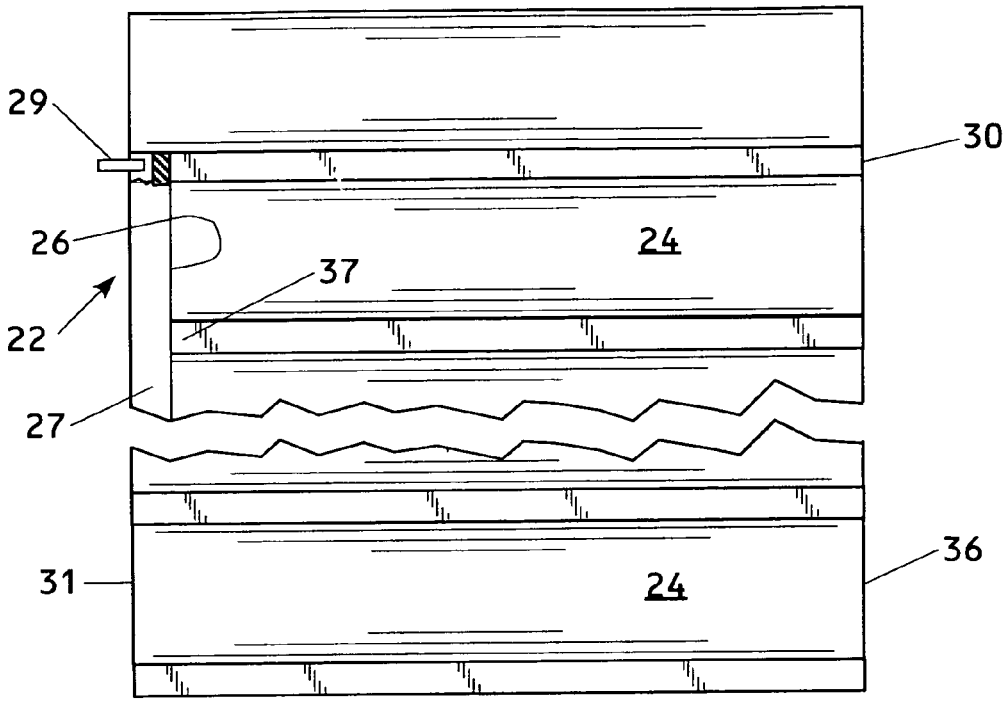
FIG. 5 is a top plan view of the underlying inflatable base only.

Referring again to the intermediate, inflatable slide support base section 25, the transverse sealed portions 30 terminate at 37 which, together with adjacent lateral edge 31, form opposite edges of non-sealed, longitudinally extending, confronting, inflatable sheet portions 26C and 28C of the confronting sheets 26 and 28, respectively to define an elongate air supply tube 27 along the left perimeter sealed edge 31 as illustrated in FIG. 5.

The transverse step filling tubes 24 have one end 26 in fluid communication with the elongate air supply tube 27 (FIG. 5) which is coupled to an air valve 29 that may be coupled to a suitable air supply source (not shown) for inflating the tubes 24. The underlying transversely extending tubes 24, when inflated and positioned in the zone C of each stairway step 14, have a sufficient diameter to hold the underside 32 of the inflated slide 20 in spaced relation with the upper forward sharp edges 17 of the treads 18 and thus yieldably support the underside 32 of the slide in spaced relation with the corner edges 17 by a distance 34 as illustrated in FIG. 3.

Figure 4:
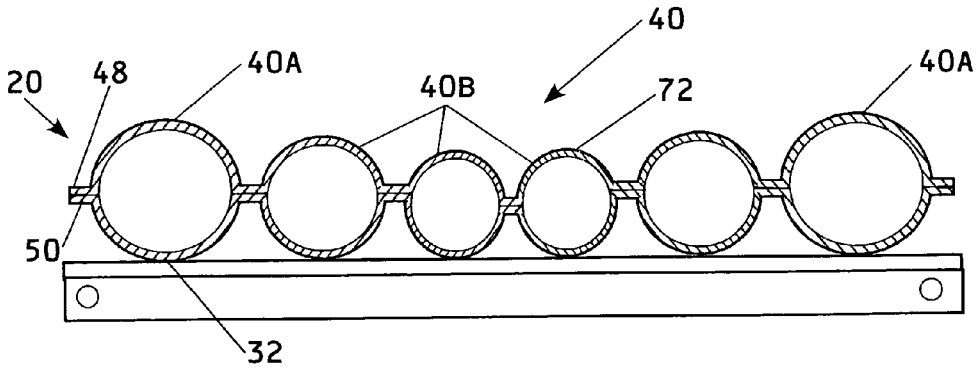
FIG. 4 is a greatly enlarged sectional end view taken along the section line 4-4 of FIG. 3.

The upper slide 20 includes a longitudinally central inflatable slide 42, a non-inflatable entrance anchoring head or approach pad 44 integrally, swingably coupled to an upstream end of inflatable slide 42 and, an independently inflatable tail, exit end deceleration pad or landing pad 46 integrally coupled to the downstream end of inflatable slide 42. The central inflatable slide 42 comprises a plurality of longitudinally extending, inflatable tubes, generally designated 40, which have laterally inwardly diminishing diameters as illustrated in FIG. 4 to form a slide channel. The longitudinal tubes 40 include a pair of large diameter, laterally outer side rail tubes 40A and a plural of intermediate lesser diameter tubes 40B therebetween having the lower surface 32 and an upper surface 72 on which the user will slide.

The entire upper slide 20 is fabricated from a pair of upper and lower PVC plastic sheets 48 and 50. The confronting portions 48A,48B and 50A,50B, respectively, of the sheets 48 and 50, respectively, between the central inflatable slide 42 and each of the anchoring head 44 and the deceleration portion 46, respectively, are heat sealed together to form longitudinally spaced laterally extending fold junctions J2 and J3 respectively, which allows the anchoring head portion 44 and the landing pad or tail portion 46 to swing, relative to the inflatable slide 42 and the plane P, to generally parallel, oppositely inclined positions lying in planes P2 and P3; respectively. The central section 42 when inflated, will lie in a plane P and the junctions J2 & J3 permit the anchoring head portion 44 and tail portion 46 to swing downwardly and upwardly, respectively, to generally parallel positions lying in parallel, horizontal planes P2 and P3, respectively, which are each parallel to the plane P1 of the entrance pad 21.

The sheets 48 and 50 include upper and lower upstream confronting sheet sections 43 and 45, respectively, heat sealed together to form the flat, approach pad 44 which overlies the base entrance pad 21. A plurality of grommets G2, which are disposed in approach pad 44, are aligned with the underlying grommets G1 of entrance pad 21, when disposed in the operative positions illustrated in FIG. 1, for receiving the fasteners 41.

The portion of the sheets 48 and 50 longitudinally disposed between the junctions J2 and J3 form the central slide section 42. The longitudinally extending, laterally spaced apart, confronting portions 51-57, as well as the confronting perimeter portions of central section 42 are heat sealed together to form a plurality of longitudinally extending, inflatable tubes 40 therebetween. Opposite ends of the heat sealed seams 51-57 terminate at upstream and downstream ends 64 and 66, which, together with sealed junctions J2 and J3 form opposite sides of transversely extending, semicylindrical open airway channels 63 & 63A, respectively. The transverse channels 63 & 63A are in open fluid communication with opposite ends of the airway passages of tubes 40. An openable and closeable air valve 65 is in communication with each of the passages 63 and 63A for admitting inflating air and exhausting same when the unit is to be stored.

Figure 2:
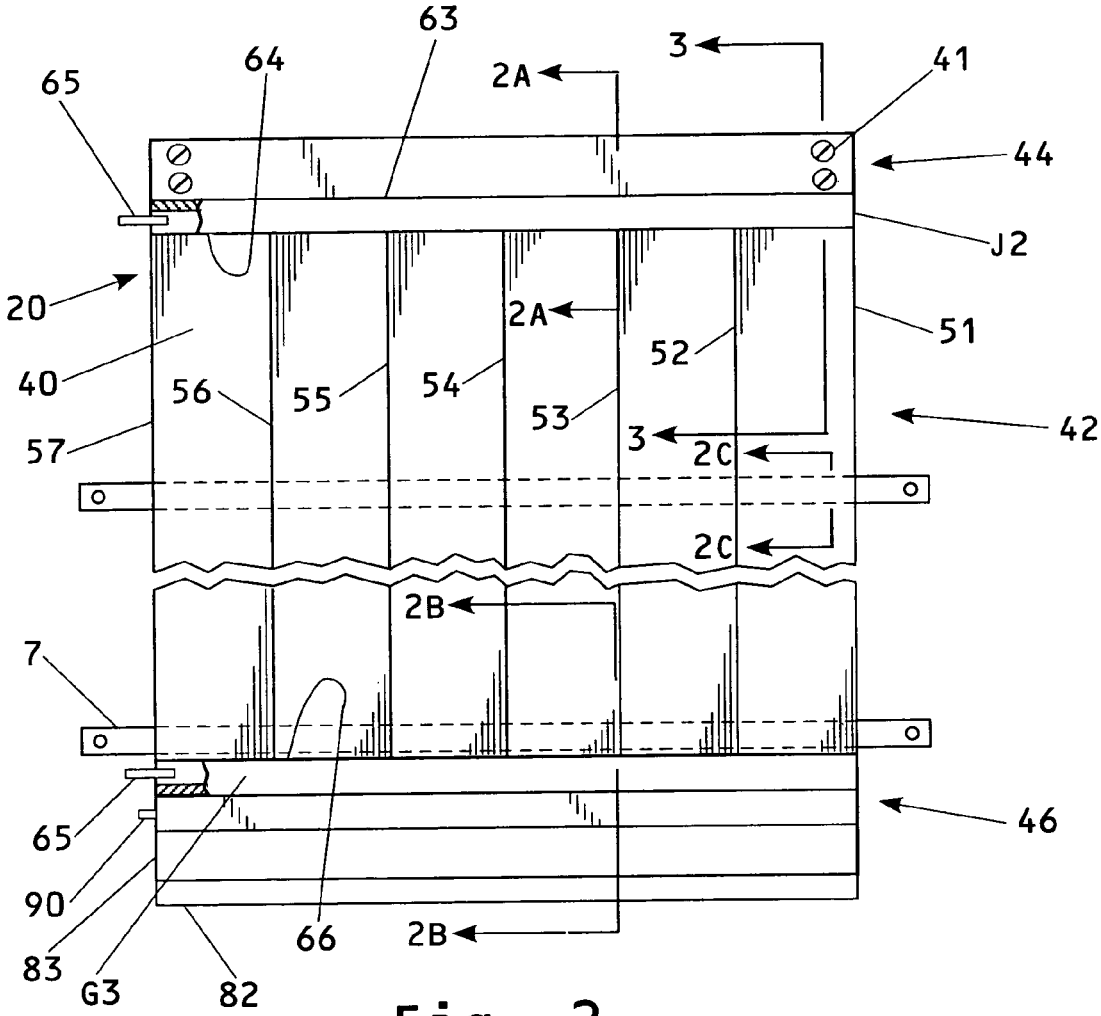
FIG. 2 is a greatly reduced top plan view of the slide assembly illustrated in FIG. 1.
Figure 2A:
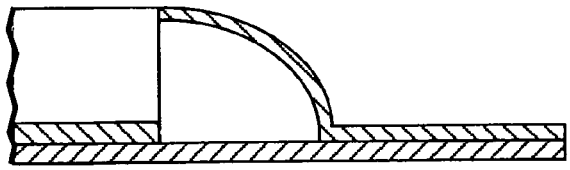
FIG. 2A is a greatly enlarged sectional side view, taken along the section line 2A-2A of FIG. 2, more particularly illustrating one of two separate transverse air passages for delivering inflation air to the inflatable slide.
Figure 2B:
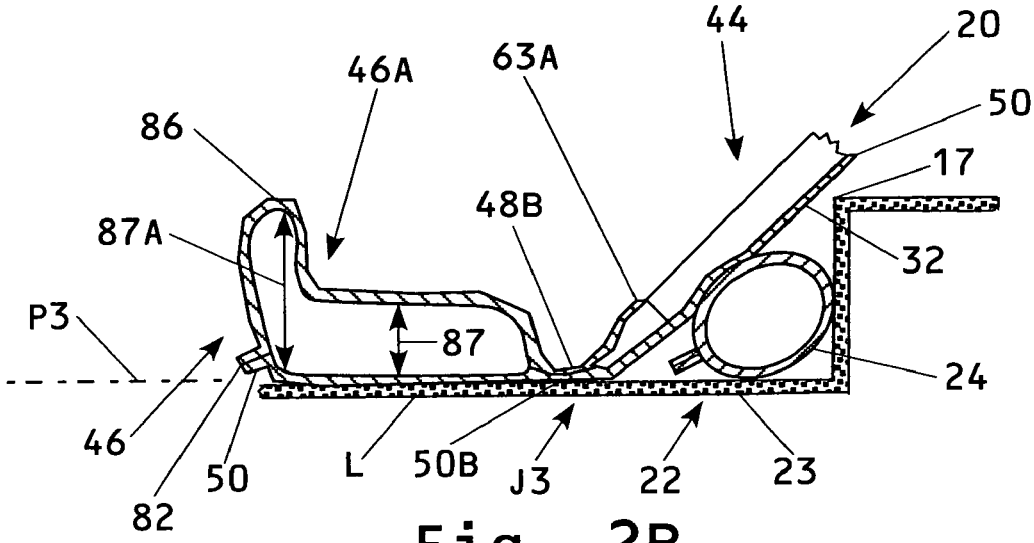
FIG. 2B is a greatly enlarged sectional side view, taken along the section line 2B-2B of FIG. 2 and more particularly illustrating the lower end portion of the stairway slide assembly and the deceleration section.
Figure 2C:
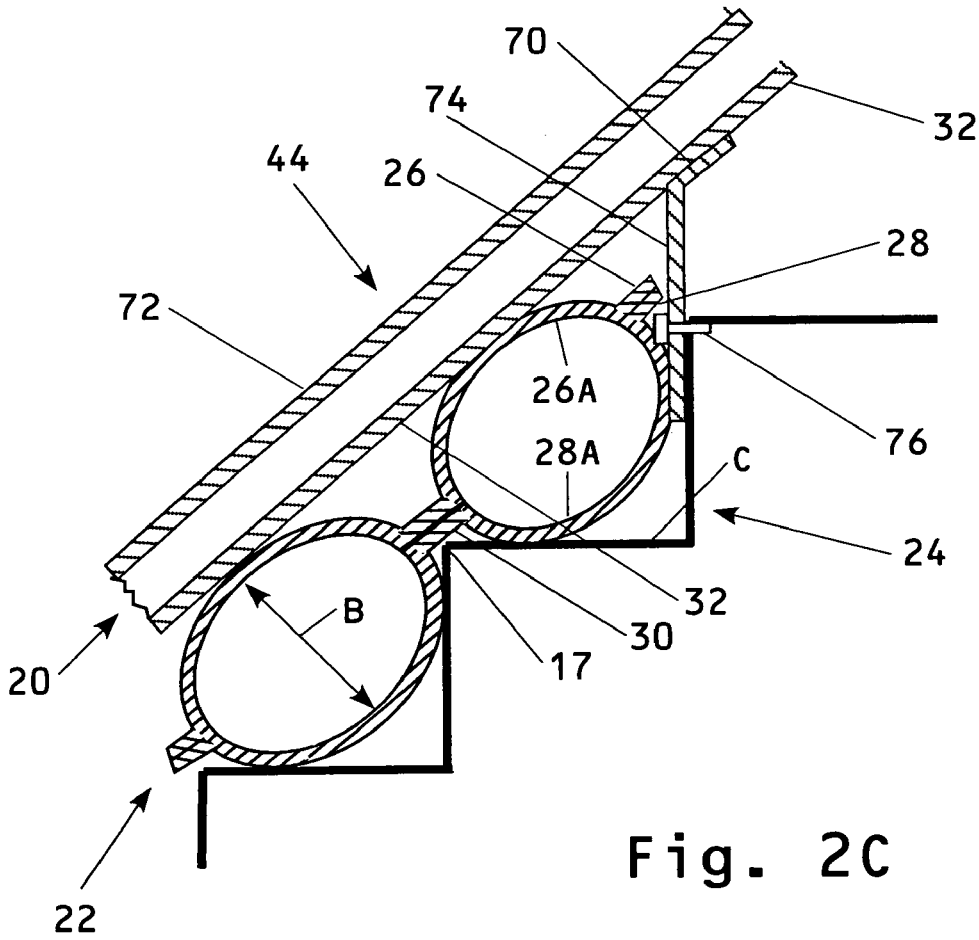
FIG. 2C is a greatly enlarged sectional side view, taken along the section line 2C-2C of FIG. 2, and more particularly illustrating one of the straps for detachably coupling the slide assembly to the underlying stairway.

As illustrated in FIGS. 2 and 2C, a plurality of transversely disposed coupling straps of PVC plastic material, generally designated 70, is heat sealed to the underside 32 of the lower PVC plastic sheet 50 and includes a laterally outer, dependent portion 74 which is detachably mounted, via fasteners 76 or the like, to the front surface of a riser 16. One or more of such straps 70 may be so positioned to inhibit lateral movement of the slide as a child slides down the slide. The upper slide surface 72 of the upper plastic sheet 48 is polished to reduce the co-efficient of friction and to better facilitate sliding down the slide.

The top sheet 48 of the slide 20 and the bottom sheet 28 of the base 22 are integrally coupled at 77 (FIG. 7) and formed from a one-piece sheet of PVC plastic whereas the bottom sheet 50 of the slide 20 and the top sheet 26 of the base 22 are integrally coupled at 79 and formed from another one-piece sheet. If desired, the entire sheet construction could be fabricated from a single sheet of PVC plastic which is initially folded on over on itself.

As illustrated in FIG. 2B, the tail end deceleration portion 46 forms a bottom ledge, mounted on the lower level floor F, swingably coupled to the mid-section 42 via the heat sealed transverse junction J3. The terminal ends 82 and lateral side edges 83 of the upper sheet 48 and 50 between the junction J3 and terminal end 82 are heat sealed together as illustrated in FIGS. 1 and 2, to define the inflatable central landing pad 46 which is separately inflatable independently of the inflation of slide tubes 40 via an air valve 90. The inflatable landing pad 46 provides a main soft landing area 46A of a predetermined inflated thickness 87 and an enlarged terminal bumper 86 of a greater predetermined inflated thickness 87A to further inhibit the user from sliding off the deceleration section 46 onto the lower level landing L.

Figure 6:
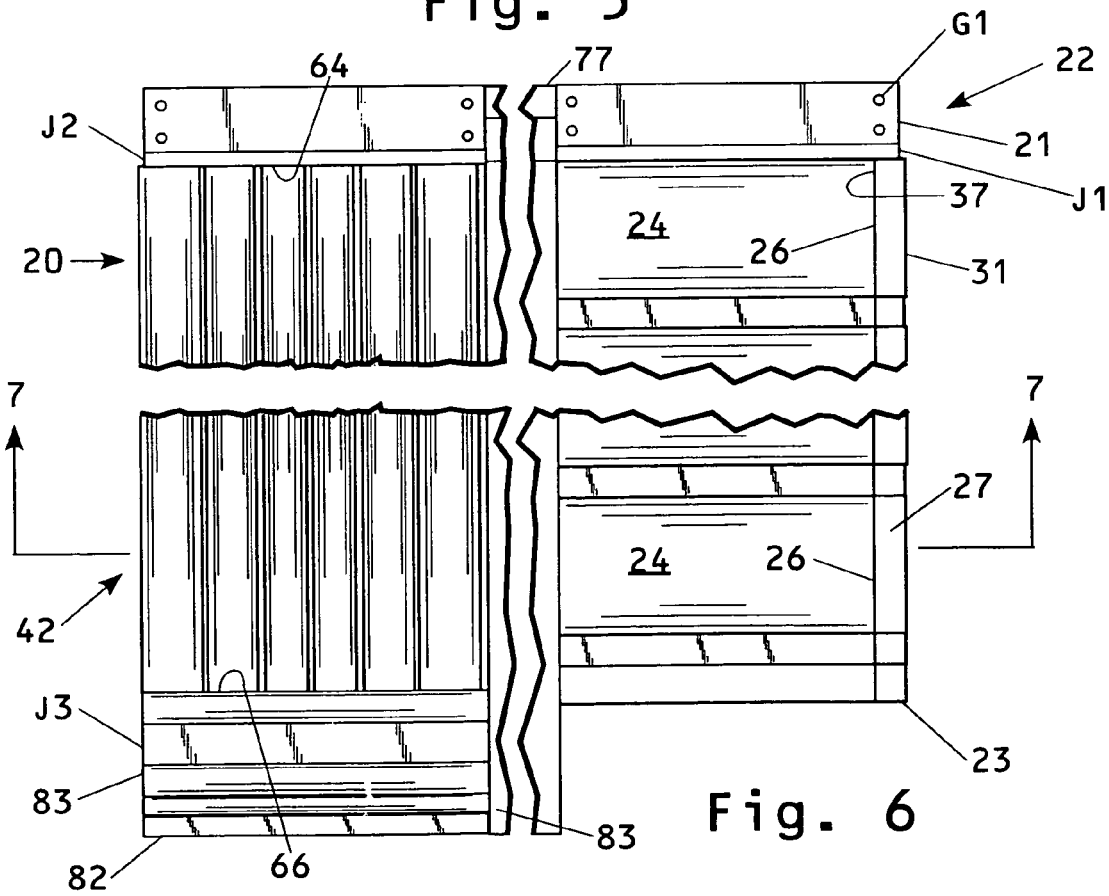
FIG. 6 is a top plan view illustrating an interim stage of assembling the inflatable stairway assembly.
Figure 7:
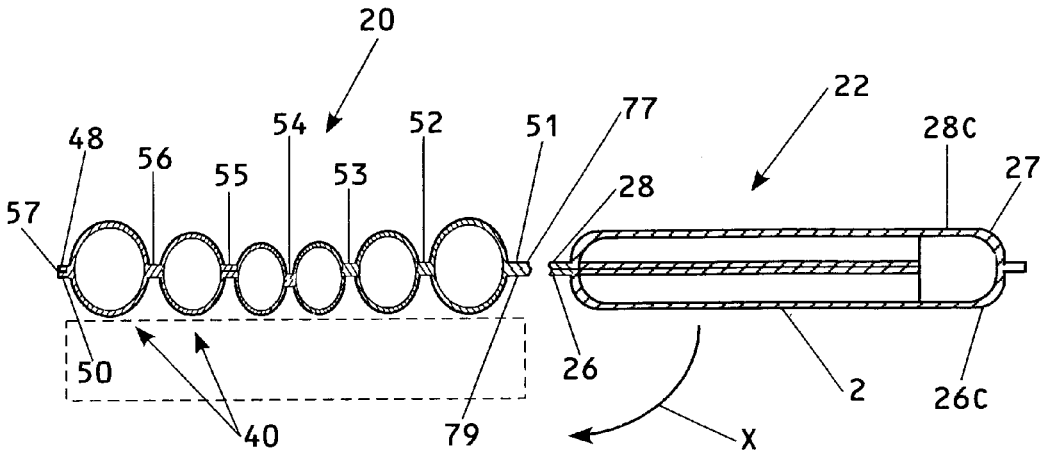
FIG. 7 is a sectional end view, taken along the section line 7-7 of FIG. 6, and more particularly illustrating the stairway slide assembly in an interim step of assembly prior to the base being swung to a position underlying the inflatable stairway slide.

As illustrated in FIGS. 6 and 7, the sheets 48 and 28 are initially generally aligned in the same horizontal plane as are the sheets 50 and 26, respectively. The inflatable base 22 is then, folded downwardly, in the direction of the arrow X, from the position illustrated in solid lines in FIG. 7 to the operative position illustrated in FIGS. 1 and 4 and in chain lines in FIG. 7 underlying the stairway slide 20 and the terminal ends 82 of the inflatable base 22 underlie the terminal end portion of tubes 40 but terminate short of the junction J3, as illustrated in FIG. 28.

It should be noted that when installed on the stairway steps, the central inflated section 42 generally lies in an inclined plane P and the upper entrance mounting section 44 can be folded or swung downwardly to lie in a generally horizontal plane P2 which is inclined downwardly relative to the plane P. The tail and deceleration section 46 is also swingable or foldable upwardly to a generally horizontal position about the sealed seam J2 to lie in a horizontal plane P3 on the landing floor L. It will be noted that the planes P1, P2 and P3 are generally horizontal and parallel to each other.

THE OPERATION

The base 22 may be folded under the slide 20, in the direction of arrow X before inflation or initially inflated in the side by side configuration illustrated in FIGS. 6 & 7 and then folded. In either case, the stairway slide 20 is inflated and disposed on the stairway 12 in the operative position illustrated in FIGS. 1 and 3 and in chain lines in FIG. 7. The entrance pad 21 and the overlying approach pad 44 are disposed in confronting relation with the grommets G1 and G2 aligned and fastened to the floor F via fasteners 41. The approach pad 44 and the entrance pad 21 of base 22 are folded downwardly relative to the inflatable base section 42 and the inflatable slide support base section 25, so that the approach pad 44 lies in the plane P3 inclined to the plane P in confronting relation with the base entrance pad 21. The deceleration tail section 46 is folded upwardly relative to the central inflatable section 42 to lie on the landing floor tin the plane P3 parallel to the plane P2. The hold down straps 70 are fastened to the steps 14 via fasteners 76.

The user will typically initially sit on the approach pad 44 and gently ease forwardly onto the central tubes 40B to slide downwardly under the force of gravity while the side rails 40A will guide the user to the exit end. When the user engages the inflatable landing pad 46, the users direction of travel will abruptly change causing the user's speed to rapidly decelerate. If the user continues to slide forwardly, the user will eventually engage the bumper 86. The slide can be quickly, easily deflated by opening air valves 29 and 90 and then compactly folded for easy storage until further use.

Alternate Embodiment

Figure 8:
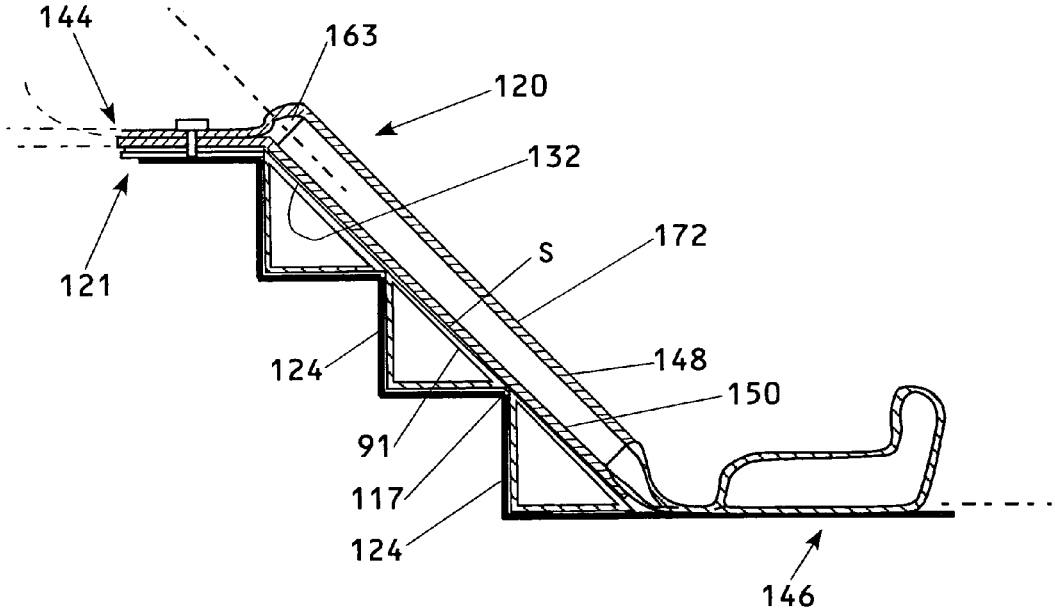
FIG. 8 is an opposite sectional side view of a slightly modified embodiment.
Figure 9:
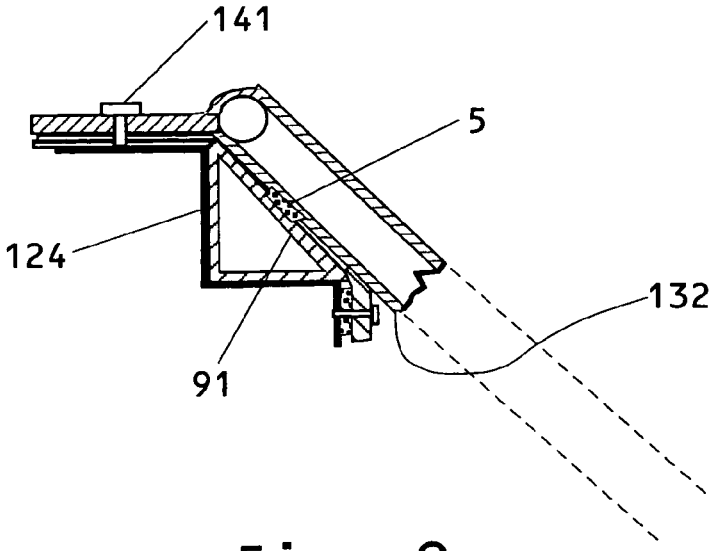
FIG. 9 is a greatly enlarged sectional side view of the portion circled in the chain lines circle 9-9 of FIG. 8.

Referring now more particularly to FIGS. 8 and 9, a slightly modified portable slide assembly, generally designated 111, is illustrated and generally similar parts will be referred to with generally similar reference characters with the number 100 added thereto.

The embodiment illustrated in FIGS. 8 and 9 primarily differs in that the individual transversely disposed inflatable tubes 124 are formed of individual sheets which are not integral with the slide 20 nor the adjacent ones of the triangular shaped inflated tubes 124. Each individual tube 124 is separately inflatable in the shape of a triangular cross section. Each tube is detachably coupled to the underside 132 of the slide 120 via cooperating velcro strips S disposed on the hypotenuse portion 91 of the inflatable tube 124 and the underside 132 of the inflatable slide 120.

Second Alternate Embodiment

Figure 10:
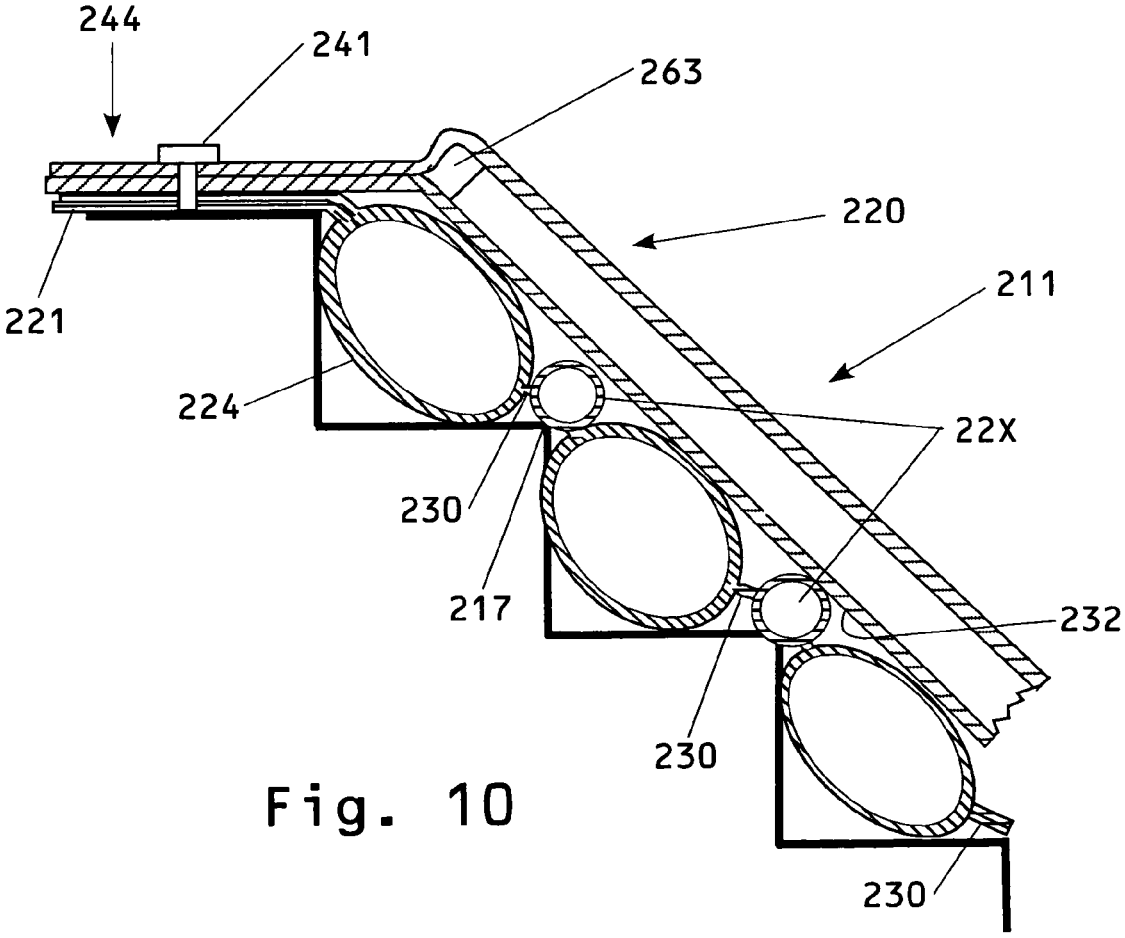
FIG. 10 is a sectional side view illustrating another slightly modified embodiment.

Referring now more particularly to FIG. 10, a further slightly modified embodiment, generally designated 211, is provided and generally similar parts will be identified with generally similar reference characters with the number 200 added thereto.

The embodiment 211 differs from the embodiment 11 in that an additional transverse inflatable edge protection tube 22X is provided in each of the transversely disposed sealed junctions 230 coupled between adjacent ones of the inflatable tubes 222. The tubes 22X are of substantially smaller diameter or breadth than the diameter or breadth of the inflated tubes 222 and have one end in fluid communication with air supply passage 7 illustrated in FIGS. 1-7. The inflatable tubes 22X are positioned so as to be in alignment with the sharp edges 217 of each step to further insure that the user's weight does not cause underside 232 of the inflatable slide 220 to engage the riser edge 217.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A recreational stairway slide assembly adapted for removable installation on an inclined stairway having a plurality of treads spaced from one another by vertical risers of selected height and extending between an upper floor and a lower landing, said slide assembly comprising:

an elongate inflatable slide member of such length as to overlie said treads and extend from said upper floor to said landing;

an inflatable base member underlying said slide member; and a plurality of inflatable tubular sections carried by and underlying said base member and being spaced from one another a distance corresponding to that of said treads thereby enabling said tubular sections to be supported by said treads, each of said tubular sections having a height so related to the height of said risers that when said tubular sections are supported by said treads said slide member occupies a level above that of said treads.

2. The stairway slide assembly set forth in claim 1 wherein said inflatable base and said inflatable slide are coupled together.

3. The stairway slide assembly set forth in claim 2 wherein said inflatable slide comprises a first pair of upper and lower confronting sheets of material sealed together at a plurality of laterally spaced apart, longitudinally extending portions to define a plurality of elongate inflatable tube sections therebetween; and wherein said base comprises a second pair of upper and lower confronting sheets of material sealed together along a plurality of longitudinally spaced, laterally extending portions.

4. The stairway slide assembly set forth in claim 3 wherein said upper sheet of said first pair of sheets and said lower sheet of said second pair of sheets are integral and said lower sheet of said first pair and said upper sheet of said second pair are integral.

5. The stairway slide assembly set forth in claim 1 including coupling means for detachably coupling said inflatable stairway slide assembly to the stairway.

6. The stairway slide assembly set forth in claim 1 wherein said inflatable slide lies in a first plane and includes an entrance end at one end of said slide and an exit end at the opposite end of said slide;

an entrance end section integral with said entrance end for disposition on said upper floor; and a deceleration exit end section integrally coupled to said exit end for disposition on said lower exit landing.

7. The stairway slide assembly set forth in claim 6 wherein said entrance end section and said deceleration exit end section are foldable downwardly and upwardly, respectively, relative to said first plane to lie in second and third parallel planes, respectively.

8. The stairway slide assembly set forth in claim 7 wherein said deceleration exit end section is inflatable independently of said inflatable slide and includes a first deceleration portion having a predetermined height and an adjacent terminal deceleration bumper having a substantially greater height relative to said predetermined height.

9. The stairway slide assembly set forth in claim 7 including anchoring means for detachably anchoring said entrance end section to the stairway.

10. The stairway slide assembly set forth in claim 1 wherein said inflatable slide includes an upstream entrance end and a downstream exit end;

and said stairway slide assembly further includes a non-inflatable approach pad integrally coupled to said upstream entrance end, and means for detachably coupling said approach pad to the upper floor.

11. The stairway slide assembly set forth in claim 10 further including an inflatable deceleration section integrally coupled to said downstream exit end; and first and second inflation means independently connected to said inflatable slide and said inflatable deceleration section, respectively, for independently inflating said inflatable slide and said inflatable deceleration section, respectively.

12. The stairway slide assembly set forth in claim 1 wherein said inflatable slide includes a plurality of laterally spaced apart, longitudinally extending inflatable tubes.

13. The stairway slide assembly set forth in claim 1 wherein said inflatable base and said inflatable slide are integral.

14. The stairway slide assembly set forth in claim 13 wherein said inflatable slide includes upstream and downstream ends; and said slide assembly further includes an independently inflatable deceleration section integrally, swingably coupled to said downstream end of said inflatable slide; and an approach pad integrally, swingably coupled to said upstream end of said inflatable slide.

15. The stairway slide assembly set forth in claim 1 wherein said inflatable tubular sections are right circular cylinders.

16. The stairway slide assembly set forth in claim 1 wherein said inflatable tubular sections are triangular in cross-section; and said stairway slide assembly further includes means detachably coupling said inflatable tubular sections to said inflatable slide.

17. The stairway slide assembly set forth in claim 1 wherein said inflatable slide comprises a first pair of upper and lower confronting sheets of air impervious material sealed together at a plurality of laterally spaced apart, longitudinally extending portions to define a plurality of elongate inflatable tube sections therebetween; and said base comprises a second pair of upper and lower confronting sheets of material sealed together along a plurality of longitudinally spaced, laterally extending portions to define said transversely disposed tubular inflatable sections therebetween.

18. The stairway slide assembly set forth in claim 17 wherein said upper sheet of said first pair of sheets and said lower sheet of said second pair of sheets are integral and said lower sheet of said first pair and said first pair and said upper sheet of said second pair of sheets are integral.

19. The assembly according to claim 1 wherein said slide member and said base member are of substantially corresponding width, said width being less than that of said stairway.

20. A stairway slide assembly for facilitating one's sliding down an inclined stairway having a plurality of treads disposed between an upper entrance end and a lower end, said slide assembly comprising:

a first pair of upper and lower, elongate air impermeable sheets disposed in confronting relation with each other and including confronting portions sealed together to form an elongate inflatable slide section lying in a first predetermined plane;

a non-inflatable anchoring section at one end of said slide section, and an inflatable decelerating end section at an opposite end of said slide section; portions of said upper and lower sheets in said non-inflatable anchoring section being sealed together and downwardly foldable to lie in a second plane inclined relative said first plane;

means for detachably coupling said portions of said upper and lower sheets in said anchoring section to the upper entrance end of the stairway;

said decelerating end section being upwardly foldable relative to said elongate slide section to lie in a third plane inclined relative to said first plane, to extend outwardly away from the lower end of the stairway.

21. The stairway slide assembly set forth in claim 20 wherein said third plane is parallel to said first plane.

22. The stairway slide assembly set forth in claim 21 wherein second confronting portions of said upper and lower sheets in said inflatable slide section are sealed together to form at least one transversely extending air passage in open fluid communication with each of said tubular sections.

23. The stairway slide assembly set forth in claim 20 wherein laterally spaced apart longitudinally extending portions of said upper and lower sheets are sealed together to define a plurality of longitudinally extending inflatable tubular sections therebetween.

24. The stairway slide assembly set forth in claim 20 further including an inflatable base comprising a transversely disposed cushioning member disposed on each of the treads for supporting longitudinally spaced portions of said slide sections in spaced relation with the treads.

25. A stairway slide assembly for mounting along less than the full width of an elongate, vertically inclined stairway having a plurality of adjacent treads; said slide assembly comprising:

an elongate, independently inflatable slide section having an upstream entrance end and a downstream exit end and adapted when inflated to lie in a first predetermined plane;

a non-inflatable approach pad integrally, swingably coupled to said upstream entrance end for movement to an inclined position lying in a second plane inclined relative to said first plane:

an independently inflatable deceleration section integrally, swingably coupled to aid downstream exit end for movement, when inflated, to a position lying in a third plane inclined relative to said first plane and parallel to said second plane; and means for detachably anchoring said approach pad to the stairway.

26. The stairway slide assembly set forth in claim 25 wherein said inflatable slide section, said non-inflatable approach pad, and said inflatable deceleration section are formed from a pair of upper and lower juxtaposed, air impervious sheets having confronting contiguous upstream end sections sealed together to form said noninflatable approach pad;

confronting downstream end sections including first confronting contiguous sheet portions sealed together, in air impervious relation to define an inflatable airway therebetween in said inflatable deceleration section; and confronting intermediate sections having upstream and downstream ends integrally coupled to said upstream end sections and said downstream end sections respectively;

said confronting intermediate sections including second longitudinally extending, laterally spaced apart confronting contiguous sheet portions between said upstream and downstream ends sealed together in air impervious relation and second inflatable sheet portions between said sections contiguous sheet portions which define inflatable airways for said slide section.

* * * * *